US010556653B2

(12) United States Patent
Lopez et al.

(10) Patent No.: US 10,556,653 B2
(45) Date of Patent: Feb. 11, 2020

(54) SELF-RIGHTING RC BOAT

(71) Applicant: HORIZON HOBBY, LLC, Champaign, IL (US)

(72) Inventors: Rafael Lopez, Champaign, IL (US); Jukka Steenari, Champaign, IL (US); Scott Hughes, Champaign, IL (US)

(73) Assignee: HORIZON HOBBY, LLC, Champaign, IL (US)

( * ) Notice: Subject to any disclaimer, the term of this patent is extended or adjusted under 35 U.S.C. 154(b) by 0 days.

(21) Appl. No.: 15/880,035

(22) Filed: Jan. 25, 2018

(65) Prior Publication Data

US 2018/0215451 A1 Aug. 2, 2018

Related U.S. Application Data

(60) Provisional application No. 62/451,702, filed on Jan. 28, 2017.

(51) Int. Cl.
*B63C 7/00* (2006.01)
*B63B 35/00* (2020.01)

(52) U.S. Cl.
CPC ..... *B63C 7/003* (2013.01); *B63B 2035/008* (2013.01)

(58) Field of Classification Search
CPC ..... B63C 7/003; B63B 2035/008
See application file for complete search history.

(56) References Cited

U.S. PATENT DOCUMENTS 4,353,702 A * 10/1982 Nagy ..... B63H 13/00 440/8
4,610,212 A * 9/1986 Petrovich ..... B63B 1/121 114/102.2
4,700,650 A * 10/1987 Nishida ..... B63C 7/003 114/125
4,784,075 A * 11/1988 Segger ..... B63C 7/003 114/39.23
4,919,067 A * 4/1990 Wenstob ..... B63C 7/003 114/121
5,056,453 A * 10/1991 Wright ..... B63C 7/003 114/345
5,191,850 A * 3/1993 Gougeon ..... B63B 15/02 114/123
2006/0205293 A1* 9/2006 Fuse ..... B63H 23/34 440/83

(Continued)

OTHER PUBLICATIONS

Streamline RC, "Thrasher Jet Boat." Kickstarter, Retrieved on Apr. 4, 2018 from url: https://www.kickstarter.com/projects/1190401842/thrasher-jet-boat; 6 pages.

*Primary Examiner* — S. Joseph Morano
*Assistant Examiner* — Jovon E Hayes
(74) *Attorney, Agent, or Firm* — Baker Botts L.L.P.

(57) ABSTRACT

A remote control boat that includes a self-righting apparatus adapted to right the boat after it has capsized. In some embodiments, a weighted coupler is attached to the motor output shaft and the drive shaft to prevent the drive shaft from moving for a period of time after the motor is turned on. In some embodiments, one or more components may be attached to the weighted coupler by a set screw configuration. In some embodiments, one or more components may be attached to the weighted coupler by a collet-type configuration.

20 Claims, 4 Drawing Sheets

(56) References Cited

U.S. PATENT DOCUMENTS

| | | | | |
|---|---|---|---|---|
| 2007/0175082 | A1* | 8/2007 | Barrett | A01K 91/02<br>43/26.1 |
| 2012/0318184 | A1* | 12/2012 | Morrison | B63B 13/00<br>114/125 |
| 2018/0215451 | A1* | 8/2018 | Lopez | A63H 23/04 |

* cited by examiner

SELF-RIGHTING RC BOAT

CROSS REFERENCE TO RELATED APPLICATIONS

This application claims priority under 35 U.S.C. § 119 to U.S. Provisional Application Ser. No. 62/451,702 filed Jan. 28, 2017, the contents of which are incorporated by reference herein in its entirety.

BACKGROUND

The present disclosure relates to a remote control ("RC") vehicle, and particularly to a RC boat. More particularly, the present disclosure relates to a RC boat configured to right itself after being capsized.

SUMMARY

According to some embodiments of the present disclosure, a RC boat is adapted to self-right after capsizing. The RC boat includes an electronic speed controller and a receiver coupled to the RC boat. The receiver is communicatively connected to a transmitter. The RC boat includes a motor coupled to a motor output shaft. A weighted coupler is coupled to the motor output shaft. A driveshaft is coupled to the weighted coupler, and a propeller is coupled to the drive shaft. The electronic speed controller may receive a command from the transmitter via the receiver and, based on the command, operate the motor. When the boat has been capsized, the weighted coupler prevents rotation of the driveshaft for a period of time such that the RC boat rights itself.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
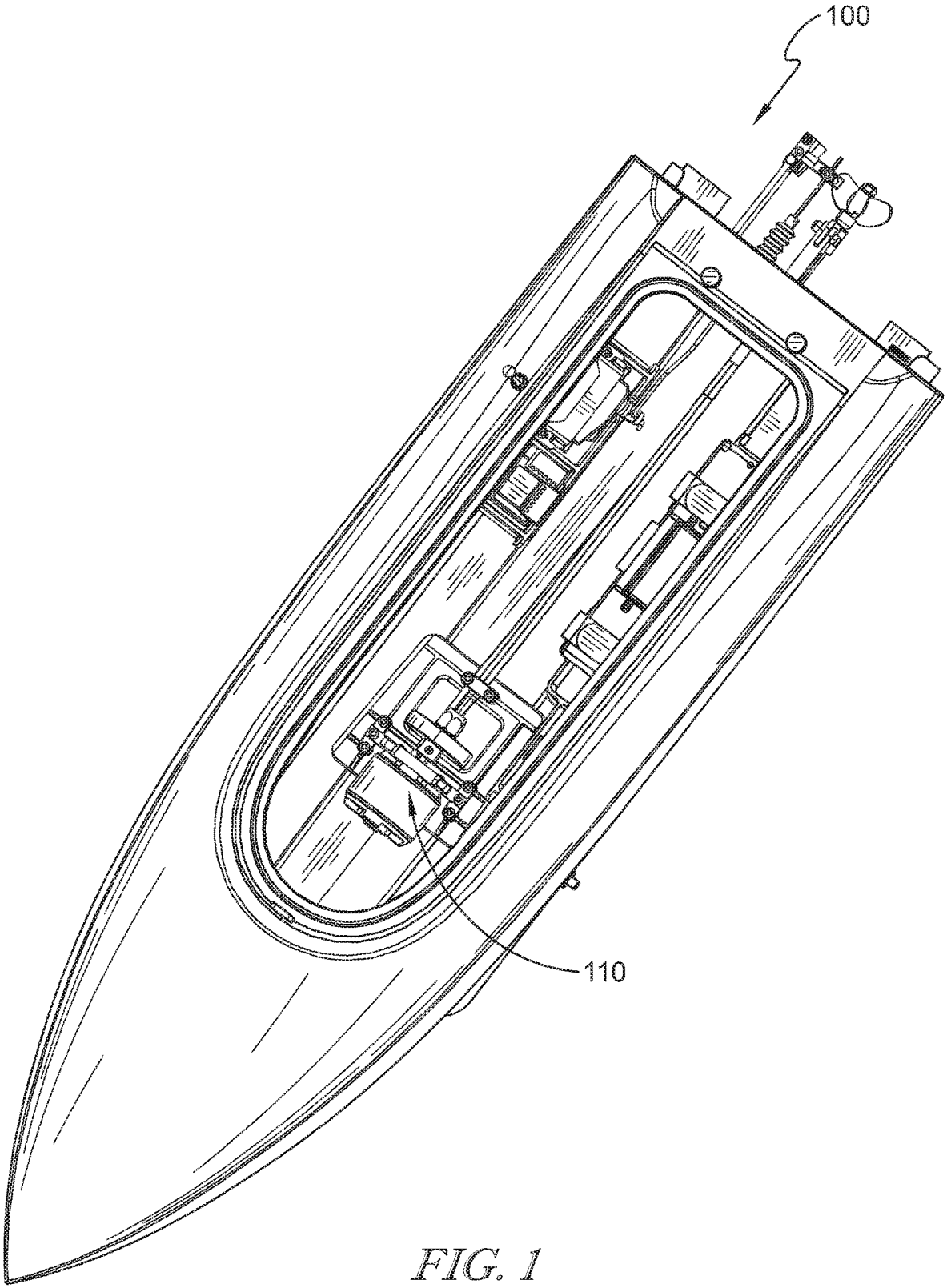
FIG. 1 is a top view of a remote control boat in accordance with the present disclosure showing that the boat includes a self-righting apparatus configured to flip the boat over after being capsized.

A remote control ("RC") boat 100 in accordance with the present disclosure is shown in FIG. 1. RC boat 100 may include a water-tight top cover that is not shown in FIG. 1 in order to show interior components and a self-righting apparatus 110. Interior components include, for example, RC accessories such as receivers, batteries, electronic speed controllers, propellers, drive shafts, motors, trays, rudders, servomotors, cables, and other components. The RC boat 100 may be remotely controlled by a user with a transmitter or controller. In operation, a user of the RC boat holds a transmitter that is in communication with a receiver on the RC boat. The transmitter transmits control signals to the receiver. The receiver provides signals to an electronic speed controller and other control elements or accessories (e.g., servomotors, lights, etc.). The electronic speed controller operates the electric motor for propulsion.

Figure 2:
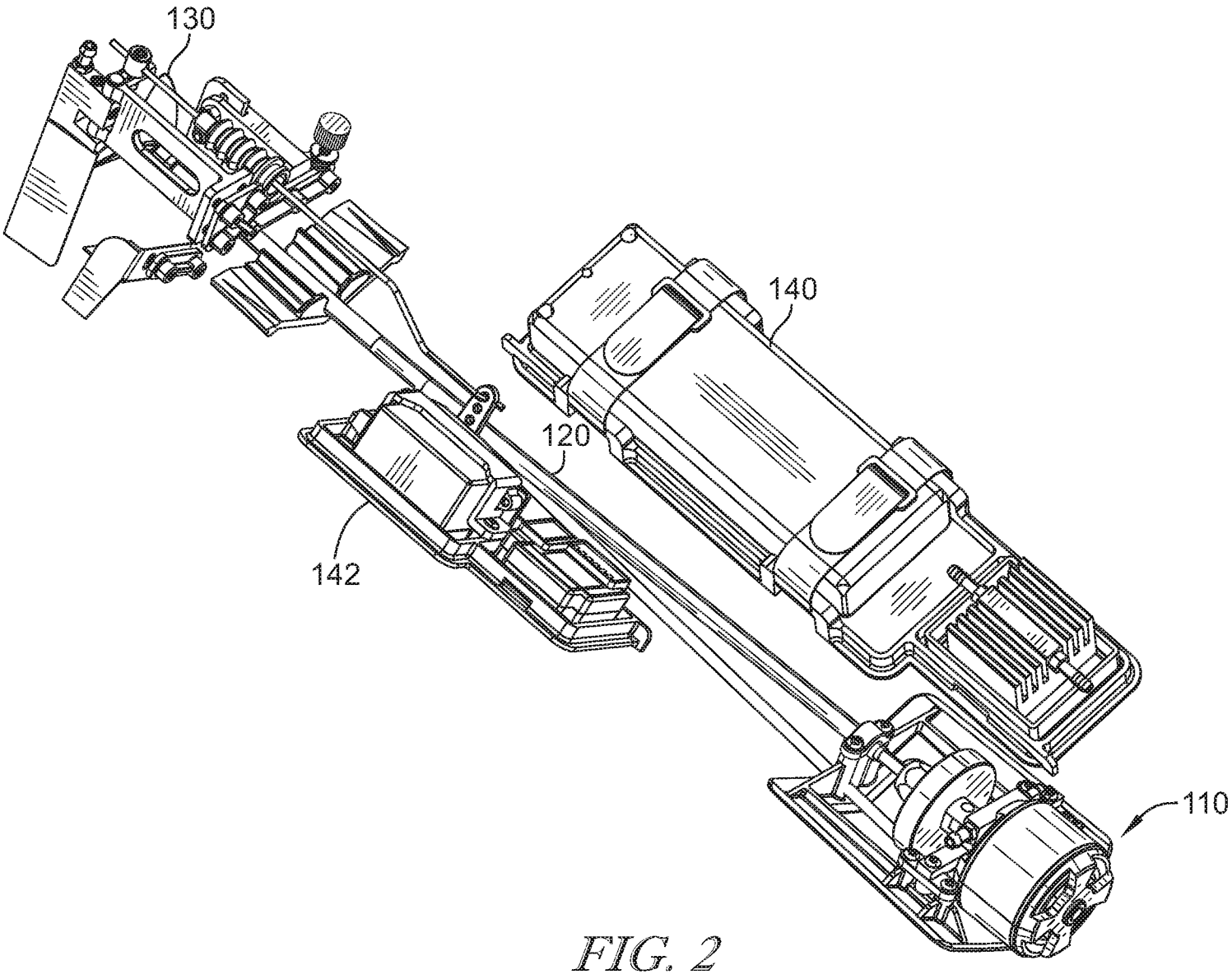
FIG. 2 is a top, perspective view of interior components of the remote control boat of FIG. 1.

FIG. 2 is a top, perspective view of interior components of the RC boat of FIG. 1. FIG. 2 shows a self-righting apparatus 110, a driveshaft 120, a propeller 130, and trays 140, 142. The trays 140, 142 may have straps or otherwise hold various interior components in place.

Figure 3:
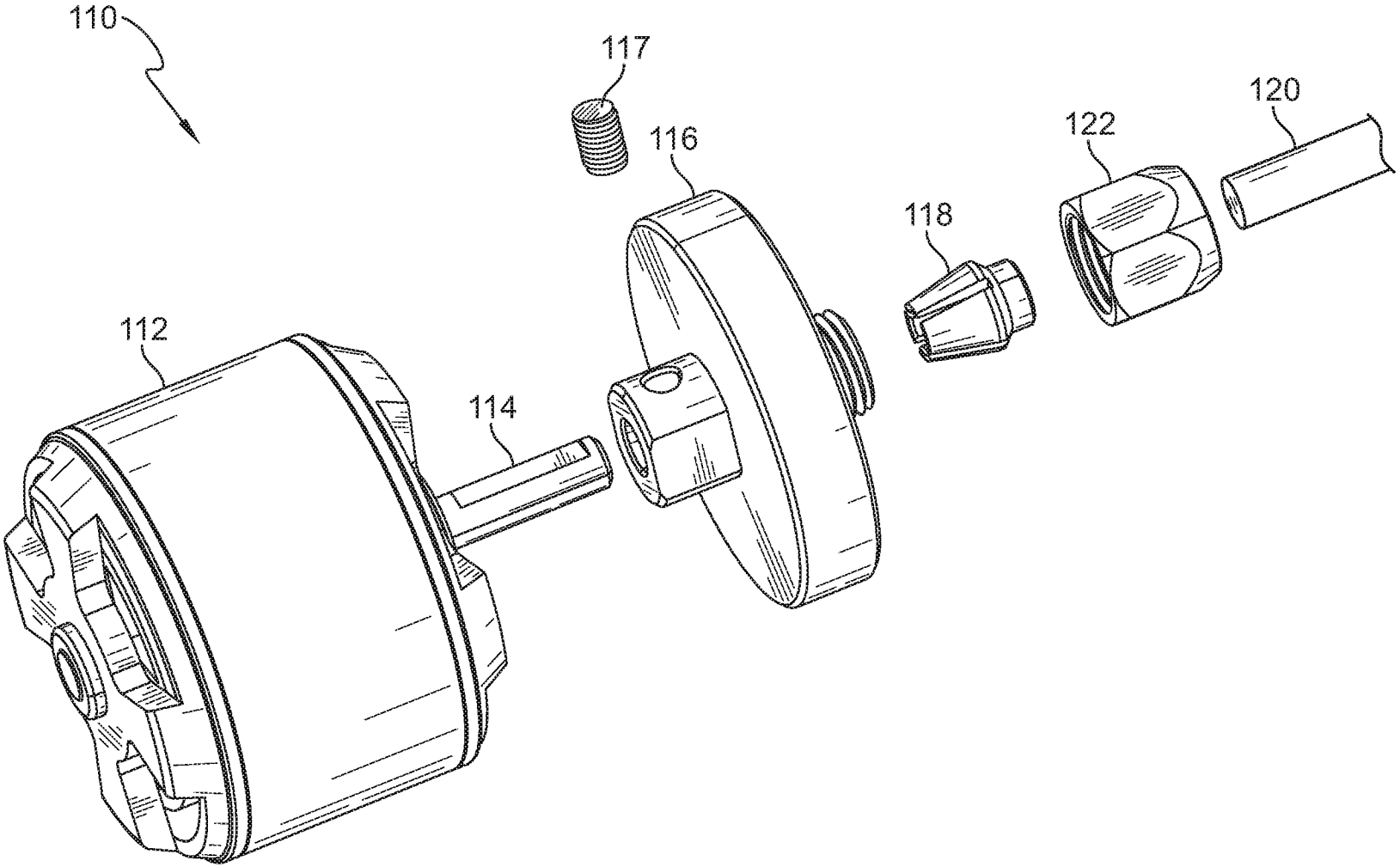
FIG. 3 illustrates an exploded, perspective view of a self-righting apparatus, according to some embodiments.

FIG. 3 illustrates an exploded, perspective view of a self-righting apparatus, according to some embodiments. FIG. 3 shows self-righting apparatus 110 that includes a motor 112 with motor output shaft 114, a weighted coupler 116 with a threaded hole matching a set screw 117, a collet 118, a cap 122, and a driveshaft 120.

The weighted coupler 116 is coupled to the motor output shaft 114 via the threaded hole of the weighted coupler 116 and the matching set screw 117. As shown in FIG. 3, the motor output shaft 114 may have a flat portion designed to help firmly couple that motor output shaft to a component via a set screw configuration.

The drive shaft 120 may be a flex drive shaft or other type of drive shaft. The drive shaft 120 is pushed through the cap 122 and the collet 118 into the weighted coupler 116. Then, the cap 122 is tightened over the collet 118, which compresses the collet 118 and holds the drive shaft 120 firmly in place. In some embodiments, the drive shaft is approximately 3.7 millimeters in diameter and the weighted coupler weighs approximately 38 grams.

In operation, the weighted coupler 116 acts as a counterweight to flip the RC boat 100 over after it has been capsized. The weighted coupler 116 prevents the motor from spinning for a small amount of time due to its weight. This allows the motor to start up, but since the motor 112 is weighted, the RC boat 100 spins rather than the connected drive shaft 120 and propeller 130. When the weighted coupler is appropriately weighted based on the characteristics of the RC boat 100 and the motor 112, this causes the RC boat 100 to self-right. Collet-style fittings have a few benefits that provide a technical advantage in the self-righting apparatus, including fast chucking (i.e., unclamping of one part, switching to a new part, and reclamping the new part), self-centering, strong clamping, resistance against being jarred loose, and precise centering. The collet-style configuration may be used to attach other components together, e.g., to attach the motor output shaft to the weighted coupler. Although a collet-style configuration is described herein, other mounting methods may be used, including chuck configurations with jaws, dogs, spiders, etc.

Additionally, in some embodiments, the rotating weighted coupler 116 counteracts at least some of the torque of the motor 112. For example, some embodiments that include outrunner motors, and/or large propellers, may use a self-righting apparatus to counteract the torque of the motor 112. In embodiments using larger propellers, an effect of the large propeller during propulsion is that the amount of water moved by large propellers causes the boat to torque roll. A self-righting apparatus can be used to help counteract that torque roll.

Figure 4:
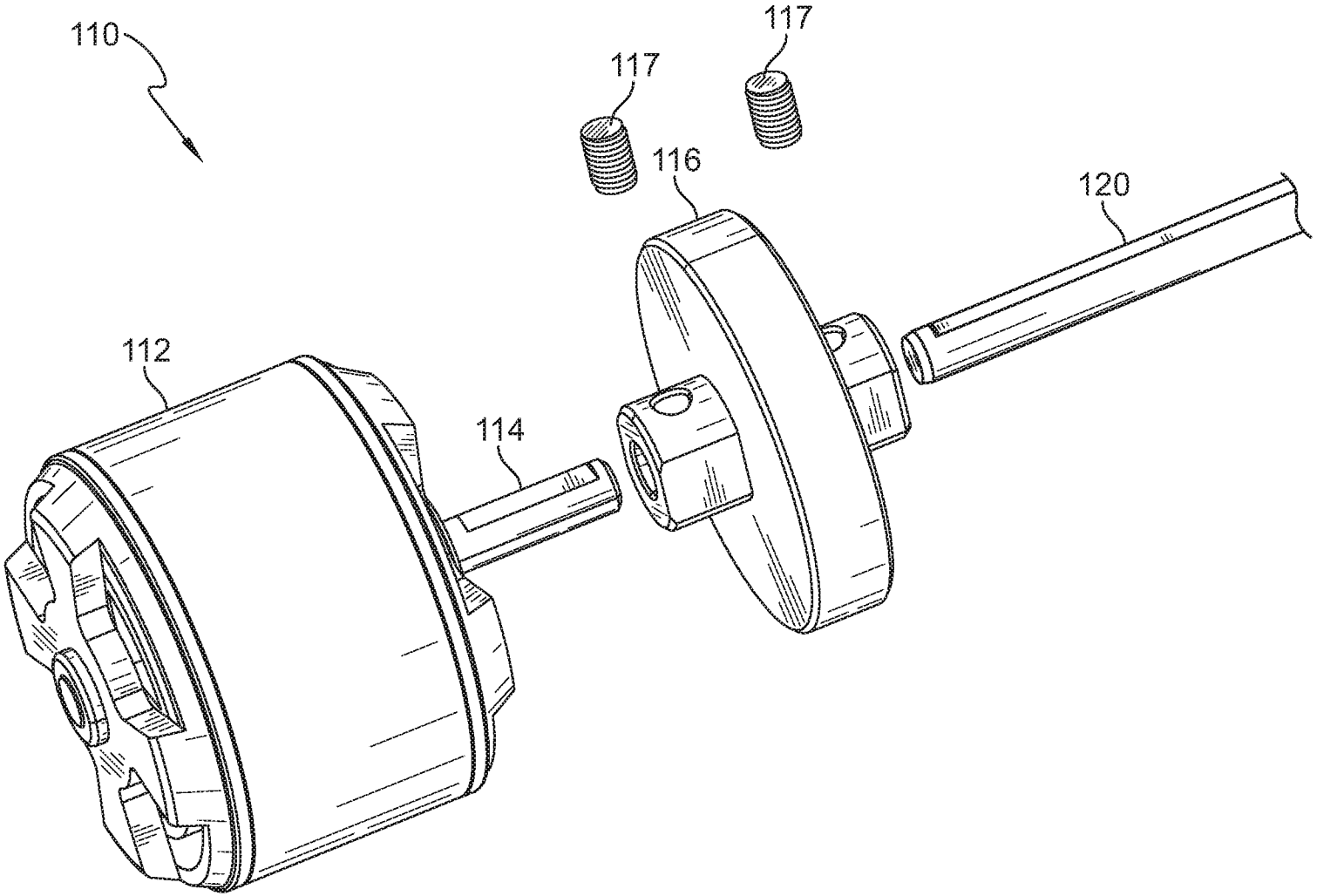
FIG. 4 illustrates an exploded, perspective view of a self-righting apparatus, according to some embodiments.

FIG. 4 illustrates an exploded, perspective view of a self-righting apparatus, according to some embodiments. FIG. 4 shows a self-righting apparatus 110 that includes a motor 112 with a motor output shaft 114, a weighted coupler 116 with two threaded holes for set screws, set screws 117, and drive shaft 120.

The weighted coupler 116 is coupled to the motor output shaft 114 via the threaded hole of the weighted coupler 116 and the matching set screw 117. Similarly, the weighted coupler 116 is coupled to the drive shaft 120 via the threaded hole of the weighted coupler and a matching set screw 117. As shown in FIG. 4, the motor output shaft 114 and the drive shaft 120 may each have a flat portion designed to help firmly couple that components via a set screw configuration. Although a set screw configuration is described herein, other mounting methods may be used, including collar mounting methods such as clamping collars, concentric clamping collars, eccentric locking collars, flange collars, etc.

Those of skill in the art will appreciate that the described systems and methods herein may be subject to various modifications and alternative constructions. There is no intention to limit the scope of the invention to the specific constructions described herein. Rather, the herein described systems and methods are intended to cover all modifications, alternative constructions, and equivalents falling within the scope and spirit of the invention and its equivalents.

The invention claimed is:

1. A self-righting apparatus for a RC boat comprising:

a motor coupled to a motor output shaft, a weighted coupler coupled to the motor output shaft;

a driveshaft coupled to the weighted coupler; and a propeller coupled to the drive shaft, wherein, when the RC boat has been capsized, the weighted coupler is configured to prevent the rotation of the driveshaft for a period of time such that the RC boat rights itself.

2. The self-righting apparatus of claim 1, wherein the weighted coupler weighs appropriately 38 grams and is weighted to self-right the RC boat.

3. The self-righting apparatus of claim 1, wherein the motor output shaft is coupled to the weighted coupler by a set screw configuration.

4. The self-righting apparatus of claim 1, wherein the drive shaft is coupled to the weighted coupler by a set screw configuration.

5. The self-righting apparatus of claim 1, wherein the propeller is an outrunner propeller.

6. The self-righting apparatus of claim 1, further comprising a collet and a cap, and wherein the driveshaft is coupled to the weighted coupler through the collet and cap.

7. The self-righting apparatus of claim 1, wherein the motor output shaft is coupled to the weighted couple by a chuck configuration.

8. The self-righting apparatus of claim 1, wherein the drive shaft is coupled to the weighted coupler by a chuck configuration.

9. The self-righting apparatus of claim 1, wherein the motor output shaft is coupled to the weighted couple by a collar configuration.

10. The self-righting apparatus of claim 1, wherein the drive shaft is coupled to the weighted coupler by a collar configuration.

11. A RC boat configured to self-right after capsizing comprising:

an electronic speed controller and a receiver, wherein the receiver is communicatively connected to a transmitter;

a motor coupled to a motor output shaft, a weighted coupler coupled to the motor output shaft;

a driveshaft coupled to the weighted coupler; and a propeller coupled to the drive shaft;

wherein the electronic speed controller is configured to receive a command from the transmitter via the receiver and, based on the command, operate the motor; and wherein, when the boat has been capsized, the weighted coupler is configured to prevent rotation of the driveshaft for a period of time such that the RC boat rights itself.

12. The self-righting apparatus of claim 11, wherein the weighted coupler weighs appropriately 38 grams and is weighted to self-right the RC boat.

13. The RC boat of claim 11, wherein the motor output shaft is coupled to the weighted coupler by a set screw configuration.

14. The RC boat of claim 11, wherein the drive shaft is coupled to the weighted coupler by a set screw configuration.

15. The RC boat of claim 11, wherein the propeller is an outrunner propeller.

16. The RC boat of claim 11, further comprising a collet and a cap, and wherein the driveshaft is coupled to the weighted coupler through the collet and cap.

17. The RC boat of claim 11, wherein the motor output shaft is coupled to the weighted couple by a chuck configuration.

18. The RC boat of claim 11, wherein the drive shaft is coupled to the weighted coupler by a chuck configuration.

19. The RC boat of claim 11, wherein the motor output shaft is coupled to the weighted couple by a collar configuration.

20. The RC boat of claim 11, wherein the drive shaft is coupled to the weighted coupler by a collar configuration.

* * * * *